US010724308B2

(12) United States Patent
Smith et al.

(10) Patent No.: US 10,724,308 B2
(45) Date of Patent: Jul. 28, 2020

(54) DRILL PIPE TORQUE REDUCER AND METHOD

(71) Applicant: FRANK'S INTERNATIONAL, LLC, Houston, TX (US)

(72) Inventors: Logan Smith, Lafayette, LA (US); Jarret Daigle, Lafayette, LA (US); Keith Lutgring, Lafayette, LA (US); Matthew Weber, Duson, LA (US)

(73) Assignee: FRANK'S INTERNATIONAL, LLC, Houston, TX (US)

( * ) Notice: Subject to any disclaimer, the term of this patent is extended or adjusted under 35 U.S.C. 154(b) by 86 days.

(21) Appl. No.: 16/050,686

(22) Filed: Jul. 31, 2018

(65) Prior Publication Data

US 2019/0040693 A1 Feb. 7, 2019

Related U.S. Application Data

(60) Provisional application No. 62/539,607, filed on Aug. 1, 2017.

(51) Int. Cl.
*E21B 17/10* (2006.01)
*E21B 17/16* (2006.01)

(52) U.S. Cl.
CPC ..... *E21B 17/1078* (2013.01); *E21B 17/1064* (2013.01); *E21B 17/1085* (2013.01); *E21B 17/16* (2013.01)

(58) Field of Classification Search
CPC ..... E21B 17/1078; E21B 17/1064; E21B 17/1085; E21B 17/105; E21B 17/16
See application file for complete search history.

(56) References Cited

U.S. PATENT DOCUMENTS

| | | | | |
|---|---|---|---|---|
| 5,069,297 | A | 12/1991 | Krueger et al. | |
| 5,579,854 | A | 12/1996 | Barry | |
| 5,901,798 | A | 5/1999 | Herrera et al. | |
| 6,250,406 | B1 * | 6/2001 | Luke | E21B 17/105 175/325.2 |
| 6,739,415 | B2 | 5/2004 | Mitchell et al. | |

(Continued)

FOREIGN PATENT DOCUMENTS

WO 98-40601 A1 9/1998

OTHER PUBLICATIONS

Jin Ho Kim (Authorized Officer), International Search Report and Written Opinion dated Nov. 28, 2018, PCT Application No. PCT/US2018/044607, filed Jul. 31, 2018, pp. 1-19.

*Primary Examiner* — Yong-Suk Ro
(74) *Attorney, Agent, or Firm* — MH2 Technology Law Group LLP

(57) ABSTRACT

An apparatus and method for reducing torque in a drill string, in which the apparatus includes a first clamp assembly including a plurality of arcuate clamp segments that are pivotally connected together, the plurality of arcuate clamp segments being configured to be positioned around and secured to an oilfield tubular so as to be rotationally fixed to the oilfield tubular, and an outer sleeve positioned around the first clamp assembly. The outer sleeve includes at least two sleeve segments assembled together to form a generally cylindrical sleeve around the first clamp assembly, and the first clamp assembly is configured to rotate with the oilfield tubular and with respect to the outer sleeve.

19 Claims, 13 Drawing Sheets

(56) References Cited

U.S. PATENT DOCUMENTS

| | | | | |
|---|---|---|---|---|
| 7,159,619 | B2 * | 1/2007 | Latiolais, Jr. ..... | B65D 59/00 138/96 T |
| 8,863,834 | B2 | 10/2014 | Buytaert et al. | |
| 2009/0308617 | A1 * | 12/2009 | Minto ..... | E21B 47/011 166/381 |
| 2015/0008042 | A1 | 1/2015 | Buytaert et al. | |
| 2017/0030151 | A1 | 2/2017 | Lutgring et al. | |

* cited by examiner

DRILL PIPE TORQUE REDUCER AND METHOD

CROSS-REFERENCE TO RELATED APPLICATIONS

This application claims priority to U.S. Provisional Patent Application having Ser. No. 62/539,607, which was filed on Aug. 1, 2017, and is incorporated herein by reference in its entirety.

BACKGROUND

Drill strings are made of a series of drill pipes that are connected together, and a drill bit is generally positioned at the lower end of the drill string to bore through the earth and create a well, enabling the recovery of hydrocarbons from subterranean reservoirs. Individual drill pipes typically have radially enlarged end connections, which allow for the drill pipes to be connected together, either end-to-end or using collars, to form the drill string. During drilling operations, the drill bit is rotated by rotating the drill string. The drill string is suspended from a drilling rig and is in tension, but in order to apply weight to cause the drill bit to bite into the earth, a bottom hole assembly is positioned just above the drill bit. The bottom hole assembly is, in effect, a number of weighted drill collars.

In extended-reach drilling, the drill bit can be several miles laterally displaced from the foot of the rig. In horizontal drilling, the bit follows an arcuate path and then drills a horizontal bore. In both extended-reach drilling and horizontal drilling, transmission of power from the rig to the drill bit may be hindered by frictional losses generated by contact between the enlarged, connected end portions of the drill pipes and the inner surface of the wellbore and/or casing that lines the wellbore.

To protect the drill string from abrasion against the side wall of the wellbore or casing, a drill pipe protector can be employed. Drill pipe protectors are typically elastomer elements that are clamped or otherwise secured to the outer diameter of the drill pipe. Such drill pipe protectors generally prevent the drill pipe from contacting inner surface of the casing or wellbore, thereby avoiding or at least mitigating frictional contact between the drill pipe body and the inner surface of the wellbore. Without a drill pipe protector, the drill string is subjected to shock and abrasion when the drill string comes into contact with the side wall of the wellbore or the casing.

Rotating drill pipe protectors have been implemented that allow for rotation between the drill pipe and the drill pipe protector, such that the drill pipe does not contact the wellbore when the rotating drill pipe is being rotated. Rotation of a drill string with respect to the rotating drill pipe protector may, however, create frictional torque on the drill string, even if to a lesser degree than the drill pipe directly engaging the casing/wellbore wall. Additionally, rotation of the drill string with respect to the rotating drill pipe protector may lead to wear and abrasions on the outer surface of the drill pipes of the drill string, and thus, may lead to a shorter life span of the drill pipe and/or the drill pipe protector.

SUMMARY

Embodiments of the disclosure may provide an apparatus for reducing torque in a drill string. The apparatus includes a first clamp assembly including a plurality of arcuate clamp segments that are pivotally connected together, the plurality of arcuate clamp segments being configured to be positioned around and secured to an oilfield tubular so as to be rotationally fixed to the oilfield tubular, and an outer sleeve positioned around the first clamp assembly. The outer sleeve includes at least two sleeve segments assembled together to form a generally cylindrical sleeve around the first clamp assembly, and the first clamp assembly is configured to rotate with the oilfield tubular and with respect to the outer sleeve.

Embodiments of the disclosure may also provide a method for installing an apparatus for reducing torque in a drill string. The method includes positioning at least one clamp assembly around a tubular. The clamp assembly includes a plurality of structural members and a plurality of radial wear members each disposed between two of the plurality of structural members and having a greater radial thickness than the plurality of structural members. The method further includes connecting together two circumferential ends of the clamp assembly. Connecting includes tightening a connection between the two circumferential ends of the clamp assembly, to cause the clamp assembly to apply a gripping force to the tubular. The method further includes assembling an outer sleeve around the clamp assembly, such that the clamp assembly is received within the outer sleeve. An inner diameter surface of the outer sleeve is configured to engage the plurality of wear members, and the outer sleeve is rotatable relative to the clamp assembly.

Embodiments of the disclosure may further provide an apparatus for reducing torque in a drill string. The apparatus includes a first clamp assembly including a plurality of arcuate clamp segments that are pivotally connected together, the plurality of arcuate clamp segments being configured to be positioned around and secured to an oilfield tubular so as to be rotationally fixed to the oilfield tubular, the clamp segments each including at least one arcuate structural member coated with a friction-reducing coating. The apparatus also includes an outer sleeve positioned around the first clamp assembly. The outer sleeve includes at least two sleeve segments assembled together to form a generally cylindrical sleeve around the first clamp assembly. The first clamp assembly is configured to rotate with the oilfield tubular and with respect to the outer sleeve.

The foregoing summary is intended merely to introduce a subset of the features more fully described of the following detailed description. Accordingly, this summary should not be considered limiting.

BRIEF DESCRIPTION OF THE DRAWINGS

The accompanying drawing, which is incorporated in and constitutes a part of this specification, illustrates an embodiment of the present teachings and together with the description, serves to explain the principles of the present teachings. In the figures.

Figure 1:
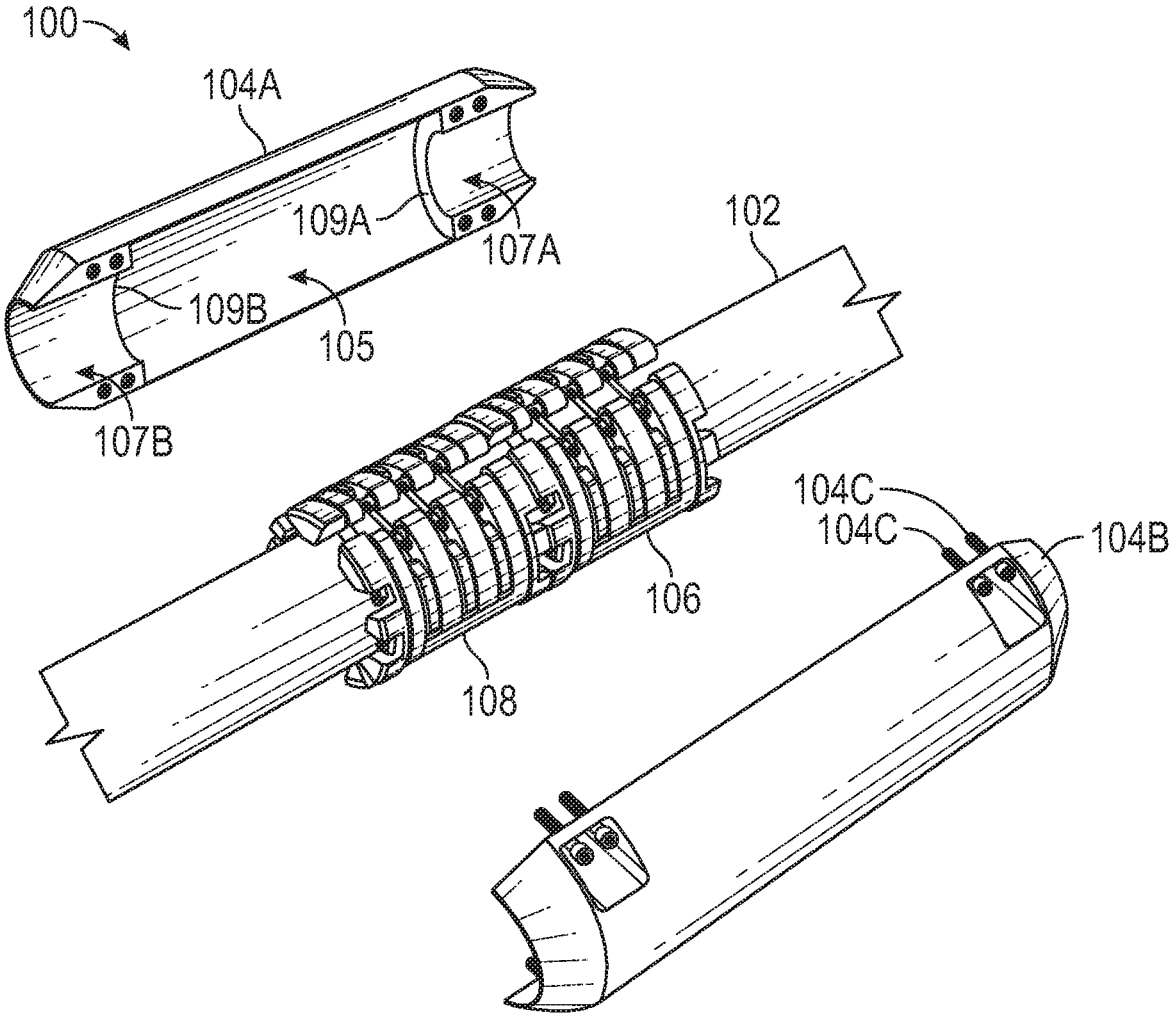
FIG. 1 illustrates a perspective, exploded view of a torque reducer installed on a drill pipe, according to an embodiment.

It should be noted that some details of the figure have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawing. In the drawings, like reference numerals have been used throughout to designate like elements, where convenient. The following description is merely a representative example of such teachings.

FIG. 1 illustrates a perspective, exploded view of a torque reducer 100 coupled to a drill pipe 102, according to an embodiment. Although described herein as being coupled to a drill pipe 102, it will be appreciated that the torque reducer 100 may be readily adapted for application with other types of oilfield tubulars, e.g., casing. The torque reducer 100 may include one or more clamp assemblies, e.g., a first clamp assembly 106 and a second clamp assembly 108. The clamp assemblies 106, 108 may be received around and secured to the drill pipe 102, as will be described in greater detail below. As illustrated, the first and second clamp assemblies 106, 108 may be positioned axially-adjacent to one another. In other embodiment, the first and second clamp assemblies 106, 108 may be separated axially apart. As the term is used herein, "axially" means generally in a direction parallel to a central longitudinal axis of the drill pipe 102 (or any other oilfield tubular to which the clamp assembly(ies) may be secured). In some embodiments, the first and second clamp assemblies 106, 108 may be substantially identical, e.g., functionally the same, but with some minor differences, e.g., incidental differences such as machining tolerances. In other embodiments, the two clamp assemblies 106, 108 may be of different designs.

The torque reducer 100 may also include an outer sleeve 104, which may, as shown, be provided as a pair of sleeve segments 104A, 104B securable together using fasteners 104C (e.g., bolts). In other embodiments, the sleeve segments 104A, 104B may be otherwise connected together, such as by adhering, clamping, crimping, etc. In some embodiments, the sleeve segments 104A, 104B may be hinged on one circumferential side and removably coupled together (e.g., fastened) on the opposite circumferential side. It will be appreciated that any number of sleeve segments 104A, 104B may be employed. The combination of the sleeve segments 104A, 104B, are positioned entirely around the first and second clamp assemblies 106, 108, so as to fully envelope the clamp assemblies 106, 108.

The outer sleeve 104 may define a clamp-receiving region 105 and two end regions 107A, 107B. As shown, portions of the clamp-receiving region 105 and the end regions 107A, 107B may be defined in each of the sleeve segments 104A, 104B. The clamp-receiving region 105 may define an inner diameter that is larger than the inner diameter of the two end regions 107A, 107B. The clamp-receiving region 105 may be configured to receive the clamp assemblies 106, 108, while the end regions 107A, 107B may be configured to be received (e.g., directly) around the drill pipe 102 (or potentially with one or more other structures therebetween). Shoulders 109A, 109B may be defined at the transition between the end regions 107A, 107B and the clamp-receiving region 105. The shoulders 109A, 109B may be located on opposite axial sides of the clamp assemblies 106, 108 when the torque reducer 100 is assembled.

The inner diameter of the outer sleeve 104 in the clamp-receiving region 105 may be slightly larger than an outer diameter of the clamp assemblies 106, 108. The inner diameter of the end regions 107A, 107B may be slightly larger than the outer diameter of the drill pipe 102; however, the radial clearance between 107 and drill pipe 102 is greater than clearance between 105 and 106. Accordingly, the outer sleeve 104 may be rotatable relative to the clamp assemblies 106, 108 and the drill pipe 102, in a manner similar to a plain bearing. By contrast, the clamp assemblies 106, 108 may be secured in position on the drill pipe 102, and may thus rotate therewith, e.g., relative to the outer sleeve 104 and/or the surrounding wellbore (e.g., a stationary frame of reference). For example, the clamp assemblies 106, 108 may be configured to facilitate such relative rotation between the clamp assemblies 106, 108 and the outer sleeve 104 by providing a low-friction, wear-resistant engagement therebetween, as will be described in greater detail below.

Figure 2:
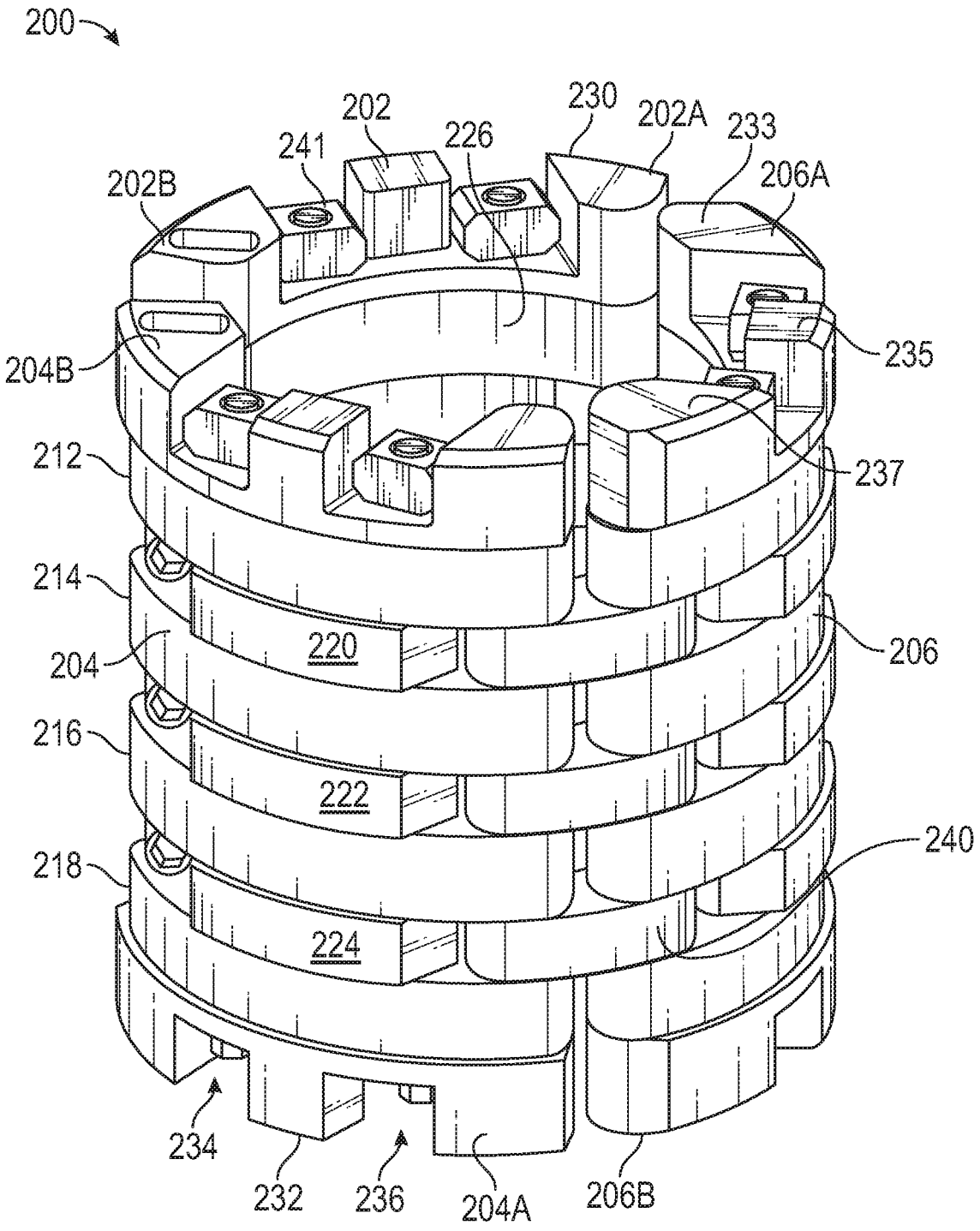
FIG. 2 illustrates a perspective view of a clamp assembly of the torque reducer, according to an embodiment.

FIG. 2 illustrates a perspective view of a clamp assembly 200, according to an embodiment. The clamp assembly 200 embodiments discussed herein may be representative of either or both of the clamp assemblies 106, 108 discussed above. Moreover, the two clamp assemblies 105, 108 may be of the same construction, or may be provided by two different embodiments, without limitation. The clamp assembly 200 may include a plurality of arcuate clamp segments, e.g., a first arcuate clamp segment 202, a second arcuate clamp segment 204, and an intermediate clamp segment 206 (collectively referred to herein as clamp segments 202-206). It will be appreciated that the intermediate clamp segment 206 may be made of a single segment (as shown) or two or more individual segments, such that the clamp assembly 200 may be made of any number of segments deemed suitable. In some cases, providing a third/intermediate clamp segment 206, in addition to the first and second clamp segments 202, 204, may provide an additional degree of tolerance for the shape of the drill pipe 102 (FIG. 1), such that the clamp assemblies 106, 108 are better able to account for ovality or variations in diameter of the drill pipe 102. Each of the clamp segments 202-206 may be about equal in circumferential width, e.g., about 120 degrees in embodiments with three segments 202-206.

Although FIG. 2 illustrates the clamp assembly 200 having three arcuate clamp segments 202-206, in some embodiments, the clamp assembly 200 may include two arcuate clamp segments instead. In some cases, two segments may provide higher axial holding force than three segments. In such embodiments, the clamp segments may be about equal in circumferential length, e.g., about 180 degrees.

In the illustrated embodiment, each of the clamp segments 202, 204, 206, may include circumferential ends 202A, 202B, 204A, 204B, 206A, 206B, respectively (collectively referred to herein as circumferential ends 202A-206B). At least some of the circumferential ends 202A-206B may be configured to be pivotally coupled to one another, and some of the circumferential ends 202A-206B may be removably coupled together so as to allow the clamp assembly 200 to be received around and secured to the drill pipe 102 or another tubular.

For example, the circumferential end 202A of the first clamp segment 202 may be pivotally coupled to the circumferential end 206A of the intermediate clamp segment 206. The circumferential end 206B of the intermediate clamp segment 206 may be pivotally coupled to the circumferential end 204A of the second clamp segment 204. Once received around the drill pipe 102, for example, the circumferential end 202B of the first clamp segment 202 may be removably (and potentially adjustably and/or pivotally) connected to the circumferential end 204B of the second clamp segment 204, e.g., using bolts, as will be described in greater detail below.

The clamp segments 202-206 may each include one or more structural members (four are shown for each segment, e.g., 212, 214, 216, 218; collectively referred to herein as structural members 212-218), and one or more radial wear members (three are shown, e.g., 220, 222, 224; collectively referred to herein as radial wear members 220-224), which are also a part of the structure. The structural members 212-218 may be arcuate and made from a relatively strong (as compared to the radial wear members 220-224) material, such as steel, although other materials are contemplated. The radial wear members 220-224 may also be arcuate and may be made from a material providing a relatively low coefficient of friction (as compared to the structural members 212-218), such as brass, composite (e.g., a fiber-reinforced) material, plastic, or a combination thereof, although other materials are contemplated. Also, in some embodiments, the radial wear members 220-224 may be coated with a material to provide a relatively low coefficient of friction, in comparison to the main body thereof. In some embodiments, the structural members 212-218 may extend along a greater arc than the radial wear members 220-224, so as to provide for connection between the clamp segments 202-206. Further, the structural members 212-218 may be separated axially apart, and may be interleaved with the radial wear members 220-224 (i.e., the radial wear members 220-224 may each be positioned between two of the structural members 212-218).

The clamp segments 202-206 may each include arcuate axial wear members 230, 232, which may be positioned on opposite axial ends of the clamp segments 202-206 and connected to the end structural members 212, 218. The arcuate axial wear members 230, 232 may each include two or more recesses 234, 236, in which bolts 241 may be positioned. The recesses 234, 236 may be positioned between wear surfaces 233, 235, 237. The bolts 241 may extend through the assembly of axial wear members 230, 232, radial wear members 220-224, and structural members 212-218, so as to fasten the assembly together. The recesses 234, 236 may provide a pocket such that the bolt 241 ends are prevented from engaging adjacent surfaces, allowing for the low-friction material of the axial wear members 230, 232 (e.g., on the wear surfaces 233, 235, 237) to provide the axial extents of the clamp assembly 200 and thus engage axially adjacent structures, as will be described in greater detail below. It will be appreciated that the assembly 200 may be connected together in a variety of different ways, with the illustrated bolts 241 being just one among many contemplated. For example, in other embodiments, the wear members 220-224, 230, 232 may be connected via pins, dovetail geometry, bonding, etc.

The radial wear members 220-224, and potentially the axial wear members 230, 232 as well, may have a greater radial thickness than the structural members 212-218. For example, the radial wear members 220-224, the structural members 212-218, and the axial wear members 230, 232 may together define an inner surface 226 of each of the clamp assembly 200, which may be generally constant and configured to engage the drill pipe 102 (FIG. 1). However, due to the greater radial thickness, the radial wear members 220-224 (and/or the axial wear members 230, 232) may protrude radially outward from the outer-most radial extent of the structural members 212-218.

As mentioned above, the circumferential end 206B of the intermediate clamp segment 206 may be pivotally coupled to the circumferential end 204A of the second clamp segment 204. In the illustrated embodiment, a plurality of links 240 may provide such pivotal coupling. For example, each of the plurality of links 240 may be positioned circumferentially adjacent to one of the radial wear members 220-224 and axially between two of the structural members 212-218. A pin may extend through the structural members 212-218 and the links 240 on each of the clamp segments 204, 206, thereby providing for a pivotal connection. The first segment 202 and the intermediate segment 204 may be similarly, pivotally coupled together with links.

In at least one embodiment, at least one of the clamp segments 202-206 may include a magnetic element configured to attract the at least one of the clamp segments 202-206 to the drill pipe 102 during installation. In some embodiments, the magnetic element may be integrated into (i.e., be a magnetized part of or embedded within) one or more of the structural members 212-218, radial wear members 220-224, and/or axial wear member 230, 232.

Figure 3:
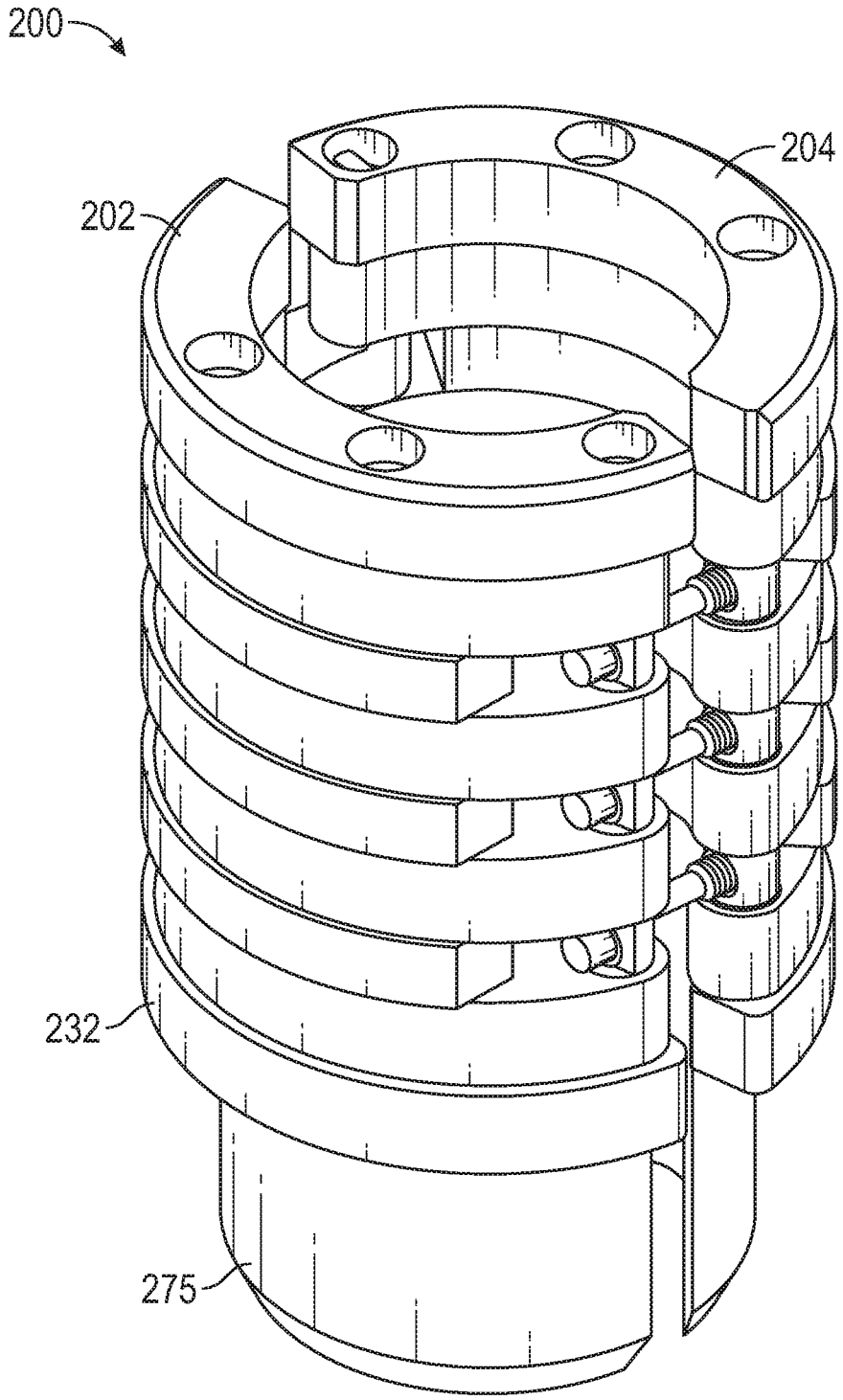
FIG. 3 illustrates a perspective view of another embodiment of a clamp assembly.

FIG. 3 illustrates a perspective view of another embodiment of a clamp assembly 200. The clamp assembly 200 includes only two arcuate clamp segments 202, 204, omitting the third (e.g., 224 in FIG. 2). Further, the clamp assembly 200 of FIG. 3 includes an extension 275 which extends axially from one of the axial wear members, e.g., axial wear member 232. The extension 275 may be configured to fit radially between the outer sleeve 104 and the drill pipe 102 (see FIG. 1). The extension 275 may provide a barrier between the inner diameter of the outer sleeve 104 and the outer diameter of the drill pipe 102 as the drill pipe 102 rotates relative to the outer sleeve 104.

Figure 4:
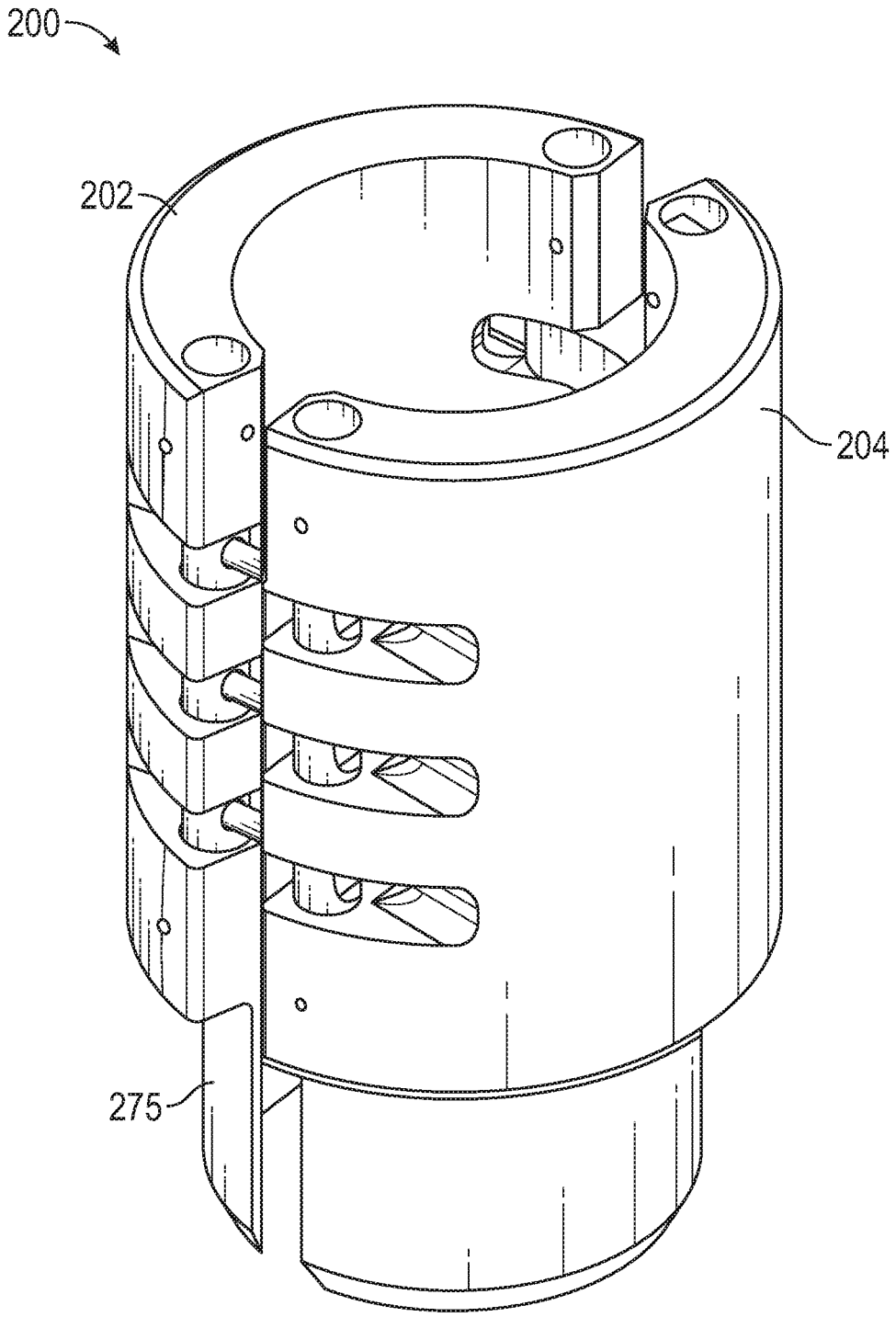
FIG. 4 illustrates a perspective view of another embodiment of a clamp assembly.

FIG. 4 illustrates a perspective view of another embodiment of the clamp assembly 200. As shown, the clamp assembly 200 includes the arcuate clamp segments 202, 204 (again, omitting the third segment 224, as shown in FIG. 2). In some embodiments, three or more segments may be employed. In this embodiment, the clamp segments 202, 204 are each made from a solid piece of material. The particular material may be any material that meets the strength requirements to perform the intended gripping function.

The outer surface of these clamp segments 202, 204 may be coated with a material providing a relatively low coefficient of friction so as to reduce friction between the clamp assembly outer surface and the inner surface of the outer sleeve during operation. This embodiment also includes the extension 275, extending from the lower (as viewed in the figure) axial end of the clamp segments 202, 204. The solid bodies of the clamp segments 202, 204 may extend, as a unitary piece from the extension 275 to the opposite axial end of the clamp assembly 200. In some embodiments, as shown, the extension 275 may form an integral part of the clamp segments 202, 204, and thus the solid body of the clamp segments 202, 204 may be considered to extend entirely between the axial ends of the clamp segment 202, 204.

Figure 5:
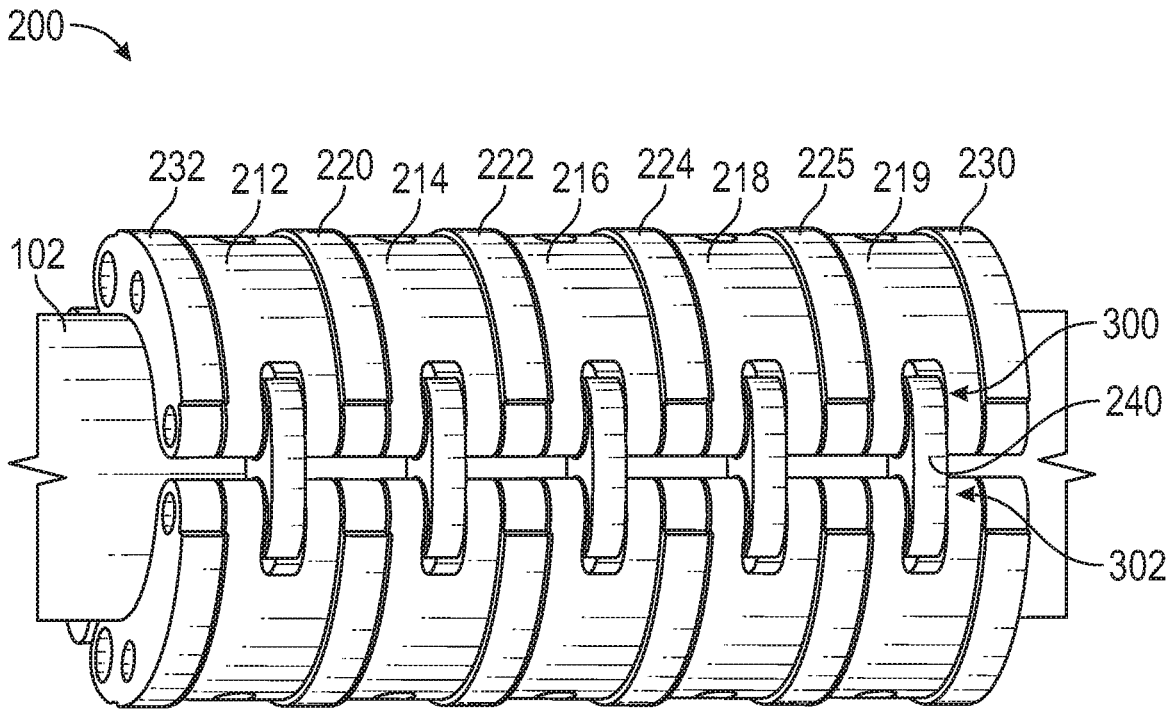
FIG. 5 illustrates a perspective view of another embodiment of the clamp assembly.

FIG. 5 illustrates a perspective view of another embodiment of the clamp assembly 200. As mentioned above, any number of structural members 212-218 and/or any number of radial wear members 220-225 may be employed. Demonstrating this point, the clamp assembly 200 provides an additional structural member 219 and an additional radial wear member 225. As shown, the radial wear members 220-225 may extend along the same arc as the structural members 212-219. To pivotally connect the ends (e.g., ends 202A and 206A) together, as shown in FIG. 5, devises 300, 302 may be machined or otherwise formed into the ends of the structural members 212-219. The links 240 may thus be pivotally coupled to the structural members 212-219 in the devises 300, 302, rather than axially between structural members 212-219.

Figure 6:
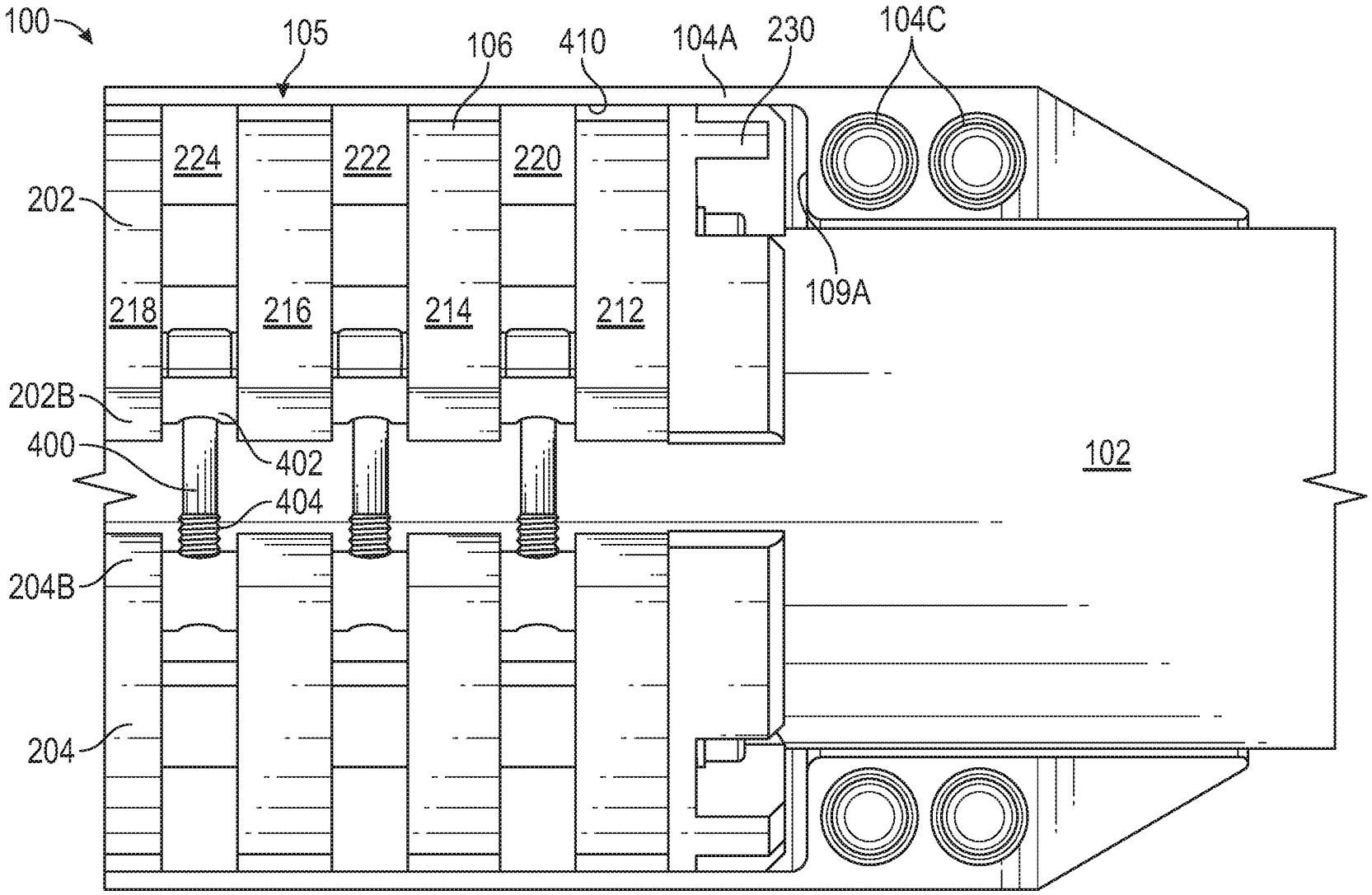
FIG. 6 illustrates a side view of a portion of the torque reducer of FIG. 1 installed on a drill string, according to an embodiment.

FIG. 6 illustrates a side view of the torque reducer 100, with one of the sleeve segments 104A positioned around one of the clamp assemblies 106, according to an embodiment. As mentioned above, the clamp assembly 106 may be formed as described with respect to an embodiment of the clamp assembly 200, and like elements are referenced by the same numbers. In particular, FIG. 6 depicts the circumferential ends 202B, 204B of the first and second clamp segments 202, 204 being connected together. As shown, fasteners 400, such as bolts, may be provided to make an adjustable and removable connection for the first and second clamp segments 202, 204. In particular, the adjustability of the connection may allow for the total circumference of the clamp assembly 200 to be adjusted, e.g., reduced, so as to adjust a gripping force applied by the clamp assembly 200 on the drill pipe 102.

For example, the fasteners 400 may be positioned between axially-adjacent structural members 212-218. The fasteners 400 may extend through pins 402 formed in the first clamp segment 202 and may be threaded into holes 404 provided in a corresponding location on the second clamp segment 204. As such, turning the fasteners 400 may serve to draw the first and second clamp segments 202, 204 closer together and reduce the overall circumference of the clamp assembly 106, thereby causing the clamp assembly 106 to grip the drill pipe 102. It will be appreciated that such adjustable and/or removable connection may be made using a variety of other structures, and that the clamp assembly 200 may include two or more sets of circumferential ends connected together in this manner.

FIG. 6 also illustrates the interaction between the sleeve segment 104A, a portion of the clamp assembly 106, and the drill pipe 102, which may be illustrative of similar interactions involving the remainder of the clamp assembly 106, sleeve segment 104B, and/or clamp assembly 108 as well. As shown, the clamp assembly 106 is received in the clamp-receiving region 105. In particular, an inner diameter surface 410 of the sleeve segment 104A engages an outer surface of at least some of the radial wear members 220-224 and an outer surface of the axial wear member 230. Further, the inner diameter surface 410 is held spaced apart from the structural members 212-218 by the protruding of the radial wear members 220-224. Thus, the low-friction wear material of the radial wear members 220-224 promotes low-friction, wear-resistant engagement between the relatively rotatable outer sleeve 104 and the clamp assembly 106.

Further, the shoulder 109A is closely proximal (e.g., potentially engaging) the axial wear member 230. Accordingly, when an axial load (e.g., to the left, in the illustration) is present, the shoulder 109A may engage the low-friction material of the axial wear member 230, thereby mitigating friction forces that would otherwise tend to impede relative rotation between the outer sleeve 104 and the clamp assembly 106. It will be appreciated that the interaction between the shoulder 109B (see FIG. 1) and the axial wear member 232 (see FIG. 2) may act similar in the presence of axial load in the opposite direction.

Figure 7:
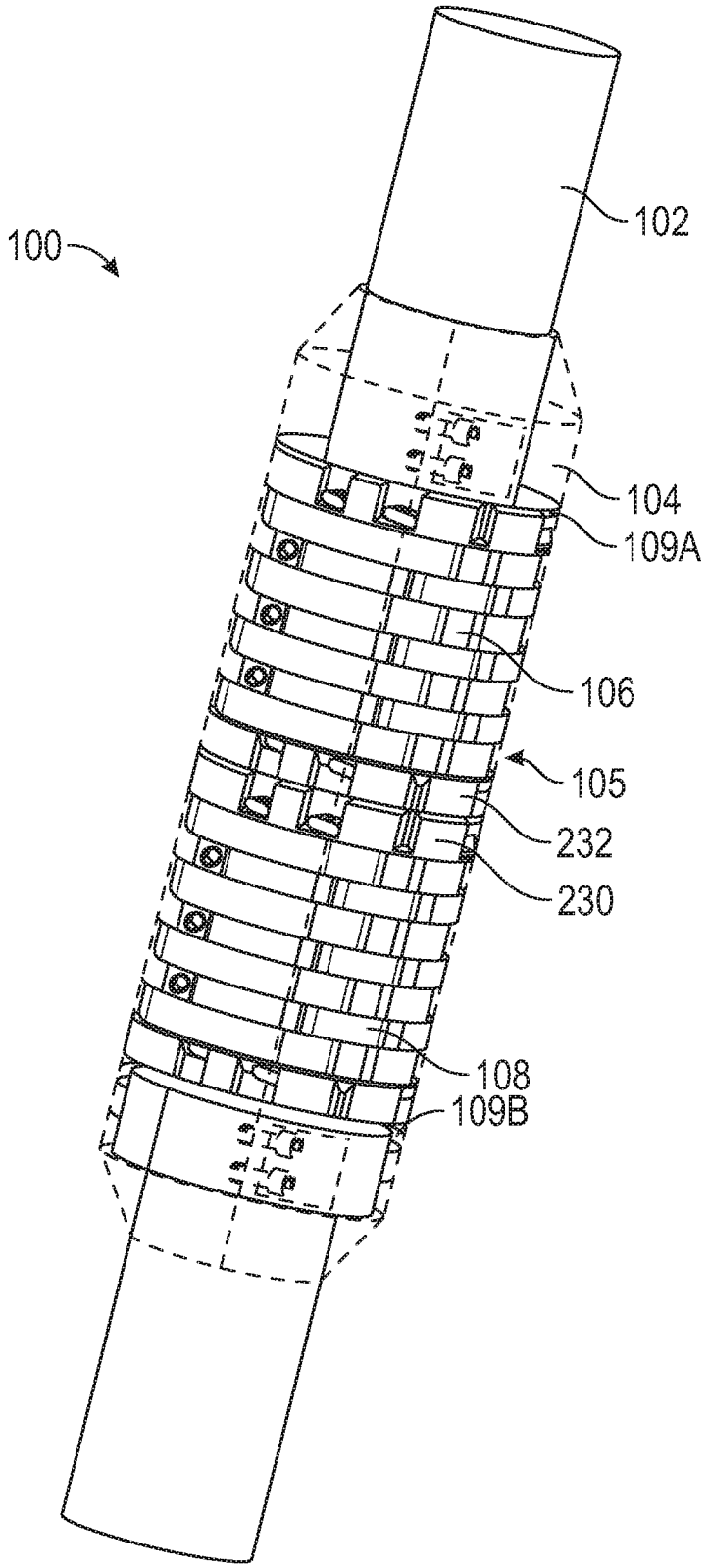
FIG. 7 illustrates a perspective view of the torque reducer installed on a drill string, with an outer sleeve thereof shown as transparent, for purposes of viewing the interior thereof, according to an embodiment.

FIG. 7 illustrates a perspective view of the torque reducer 100, with the outer sleeve 104 assembled over the clamp assemblies 106, 108, according to an embodiment, and shown as transparent, to allow viewing of the clamp assemblies 106, 108. The clamp assemblies 106, 108 being adjacent to each other may result in the axial wear member 232 of the first clamp assembly 106 engaging the axial wear member 230 of the second clamp assembly 108. Further, the first and second clamp assemblies 106, 108 are positioned in the clamp-receiving region 105, between the shoulders 109A, 109B. The clamp assemblies 106, 108 may be integral, making up one single assembly equal in length to the combination of the clamp assemblies 106, 108.

Figure 8:
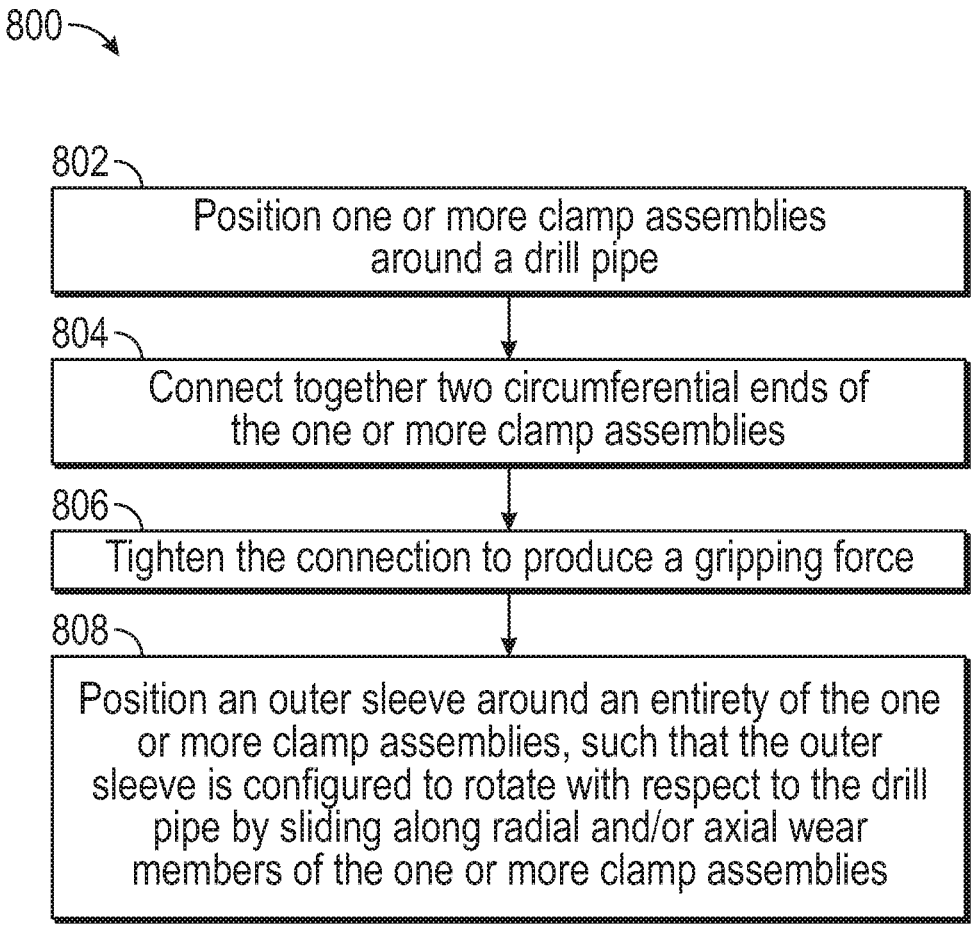
FIG. 8 illustrates a flowchart of a method for installing a torque reducer on a drill pipe, according to an embodiment.

FIG. 8 illustrates a flowchart of a method 800 for installing a torque reducer, according to an embodiment. The method 800 may be implemented using an embodiment of the torque reducer 100 described above with reference to FIGS. 1-7, and thus may be best understood by reference thereto. Some embodiments may, however, be implemented using other structures, and thus the present method 800 should not be considered limited to any particular structure unless otherwise stated herein.

Figure 9:
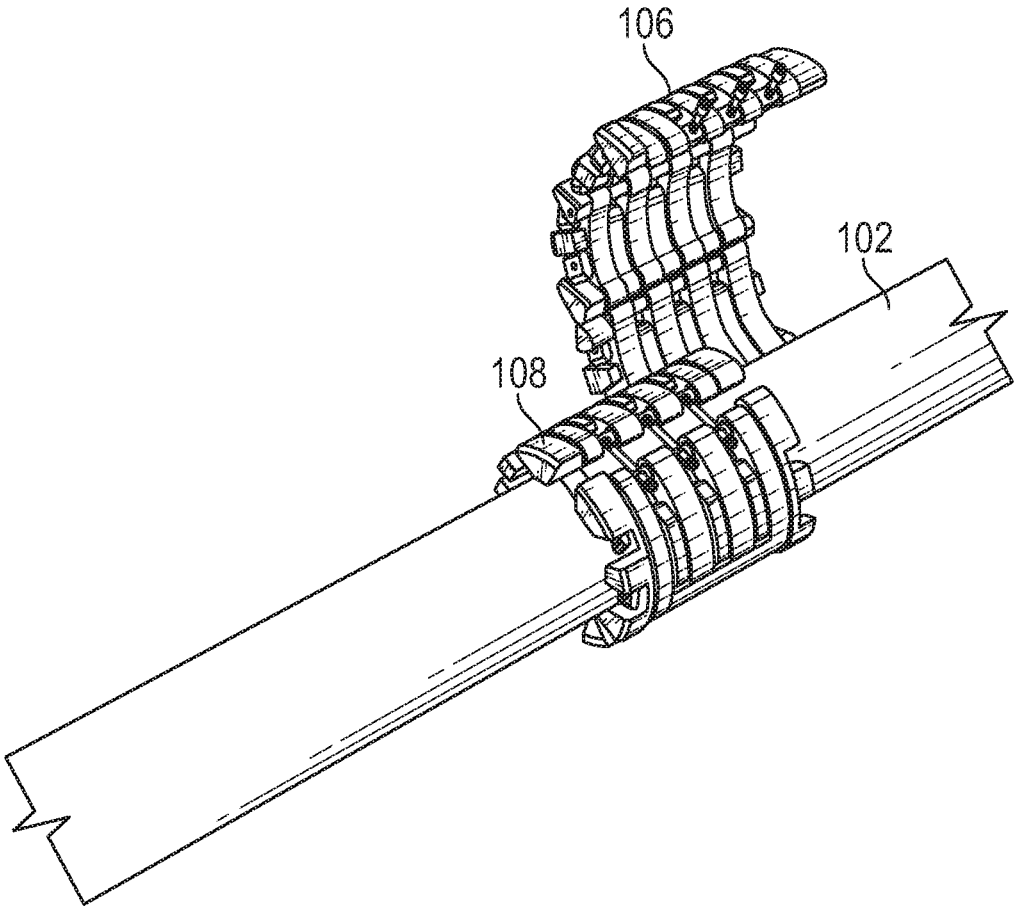
FIG. 9 illustrates a perspective view of a pair of clamp assemblies of a torque reducer being installed on a drill pipe, according to an embodiment.

The method 800 may begin by positioning one or more clamp assemblies 106, 108 around a drill pipe 102, as at 802. FIG. 9 illustrates, according to an example, the first clamp assembly 106 in the process of being positioned around the drill pipe 102, with the axially-adjacent second clamp assembly 108 having already been positioned around the drill pipe 102. The clamp assemblies 106, 108 may be received laterally onto the drill pipe 102, e.g., rather than over an end thereof. As described above, the segments 202-206 of the clamp assemblies 106, 108 may be pivotally coupled together, allowing the clamp assemblies 106, 108 to articulate and move open and closed. This may facilitate receiving the clamp assemblies 106, 108 around the drill pipe 102, including situations in which the drill pipe 102 is not perfectly round and varies from a nominal diameter thereof. In some embodiments, at least a portion of at least one of the clamp assemblies 106, 108 may be magnetic, so as to attract the clamp assembly 106, 108 to the drill pipe 102 and facilitate installation.

The method 800 may also include connecting together two circumferential ends 202B, 204B of clamp segments 202, 204 of the one or more clamp assemblies 106, 108, as at 804. As best shown in FIG. 6, the clamp segment ends 202B, 204B may be connected together so as to hold the clamp segment 106 around the drill pipe 102. A variety of different connections may be employed to hold the circumferential ends 202B, 204B together. In some embodiments, the connections may be made by bolts or other adjustable fasteners. In such case, the method 800 may include tightening the connection to produce a gripping force that holds the clamp assemblies 106, 108 to the drill pipe 102, as at 806. In other embodiments, the connection may not require tightening to produce the gripping force.

The method 800 may also include positioning an outer sleeve 104 around an entirety of the one or more clamp assemblies 106, 108, such that the outer sleeve 104 is configured to rotate with respect to the drill pipe by sliding along radial and/or axial wear members of the one or more clamp assemblies, as at 808.

Figure 10:
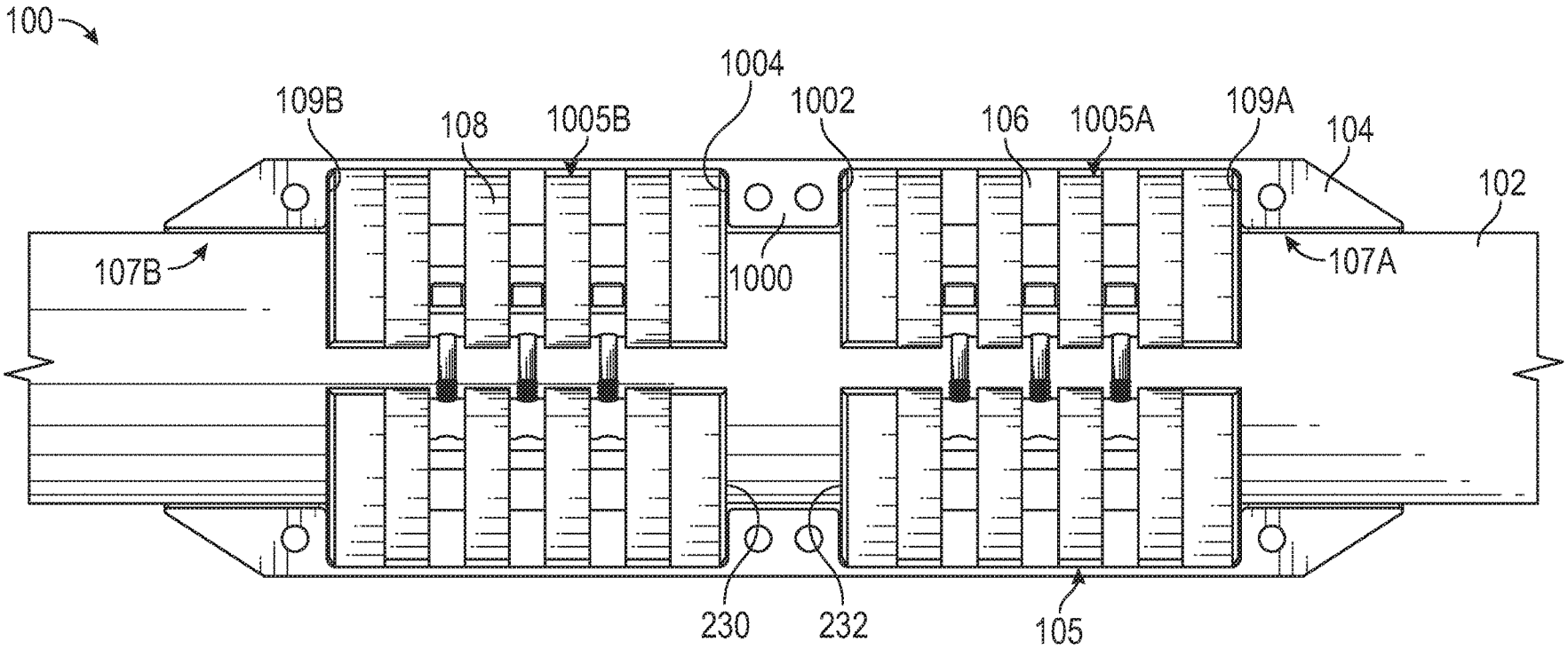
FIG. 10 illustrates a side view of another embodiment of the torque reducer.

FIG. 10 illustrates a side view of another embodiment of the torque reducer 100. In this embodiment, the torque reducer 100 includes the first and second clamp assemblies 106, 108, which are positioned around and tightened to grip the drill pipe 102. The clamp assemblies 106, 108 are also spaced axially apart in this embodiment. The outer sleeve 104, which is assembled around the clamp assemblies 106, 108, includes a medial shoulder 1000 that extends inwards in the clamp-receiving portion 105. The medial shoulder 1000 is configured to be positioned axially intermediate of the spaced-apart first and second clamp assemblies 106, 108, as shown. The medial shoulder 1000 may have two axially-facing surfaces 1002, 1004, which face in opposite axial directions.

The medial shoulder 1000 may thus partition the clamp-receiving portion 105 into two, smaller clamp-receiving portions 1005A, 1005B, each receiving one of the clamp assemblies 106, 108. The clamp-receiving portions 1005A, 1005B may have an axial length that is slightly larger than the axial length of the clamp assembly(ies) 106, 108 positioned therein, such that some amount of axial clearance is provided between the outer sleeve 104 and the clamp assemblies 106, 108. It will be appreciated that two or more clamp assemblies may be positioned in either or both of the clamp-receiving portions 1005A, 1005B. Moreover, it will be appreciated that the outer sleeve 104 may include more than one medial shoulder, and thus more than two clamp-receiving portions, each potentially including one or more clamp assemblies therein.

Referring again to the illustrated embodiment, when the first and second clamp assemblies 106, 108 rotate with respect to the outer sleeve 104 (as by rotation of the drill pipe 102), the axial wear member 232 of the first clamp assembly 106 and/or the axial wear member 230 of the second clamp assembly 108 may slide against the corresponding axially-facing surface 1002, 1004 of the medial shoulder 1000. Which (if any) of the clamp assemblies 106, 108 engages the shoulder 1000 may depend on a direction of an axial (e.g., drag) force incident on the outer sleeve 104.

As can also be seen in FIG. 10, the axial wear members 230, 232 do not include the recesses 234, 236 (see FIG. 2). Rather, the bolts 241, which are not visible in FIG. 10, may be received into counter-sunk holes formed in the axial wear members 230, 232, thus preventing the bolts 241 from engaging adjacent structures in the same manner as the recesses 234, 236. This counter-sunk hole embodiment may be applied with any of the embodiments described herein.

Figure 11:
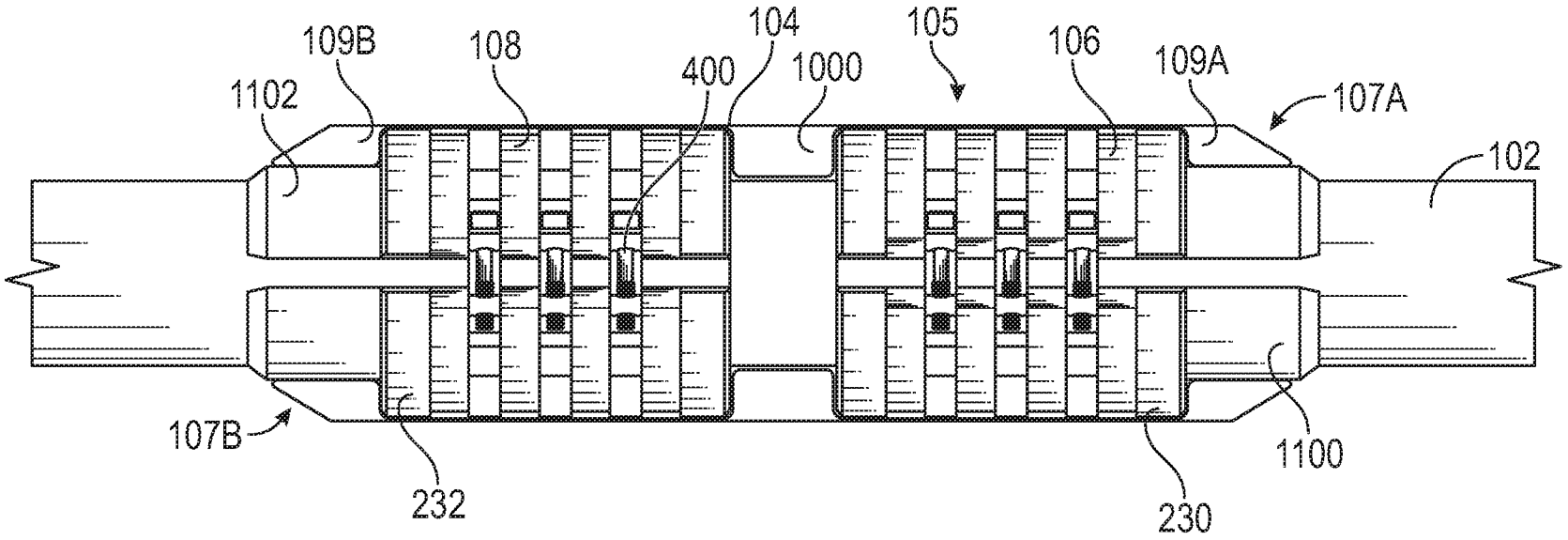
FIG. 11 illustrates a side view of another embodiment of the torque reducer.
Figure 12:
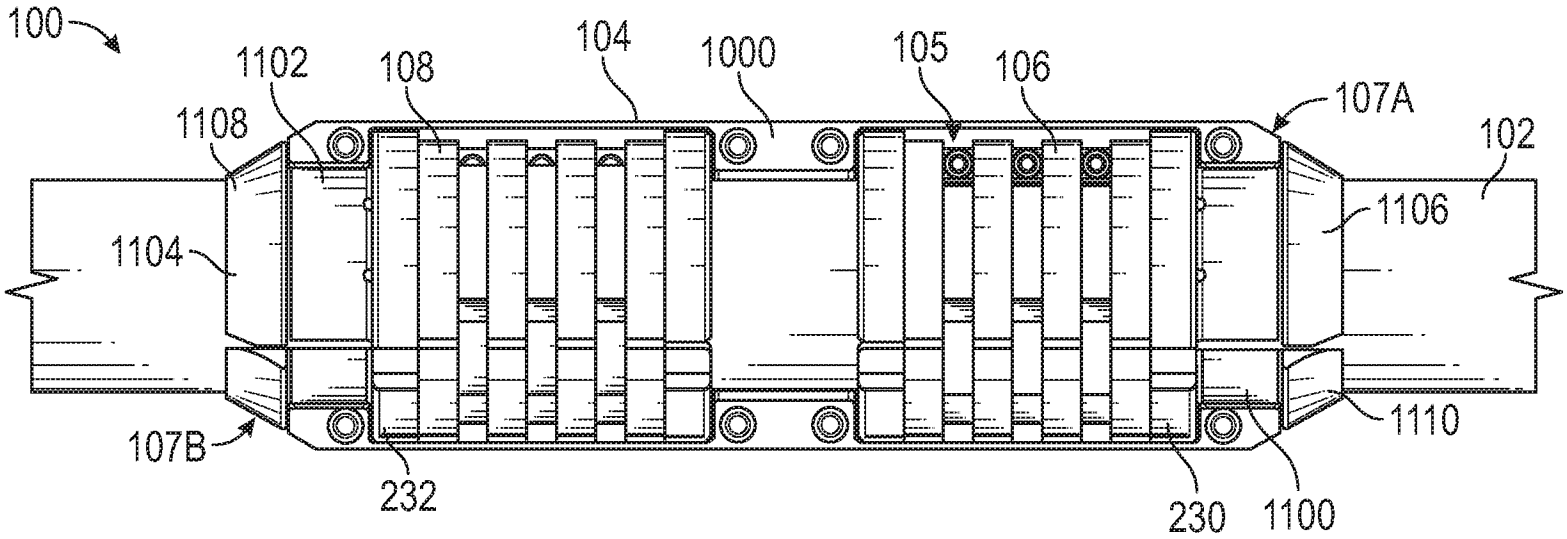
FIG. 12 illustrates a side view of another embodiment of the torque reducer.
Figure 13:
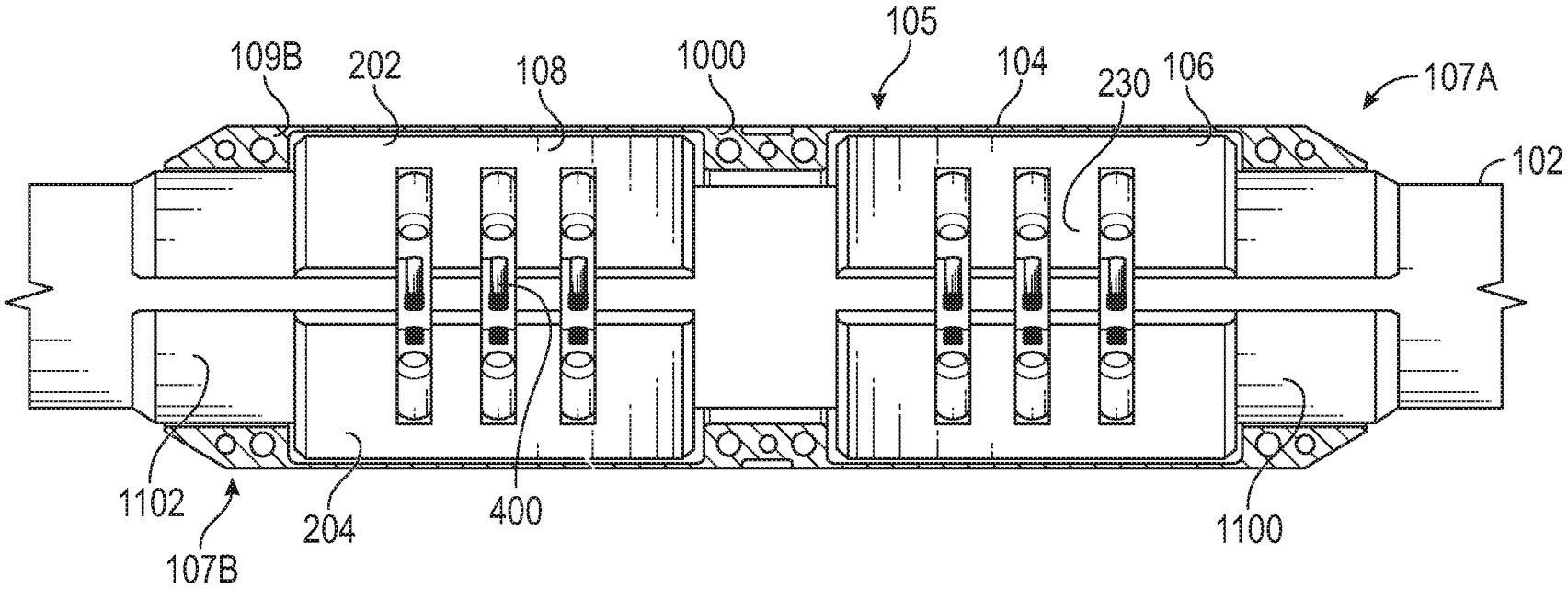
FIG. 13 illustrates a side view of another embodiment of the torque reducer.

FIGS. 11, 12, and 13 each illustrate a side view of another embodiment of the torque reducer 100. In these embodiments, extensions 1100, 1102 may extend axially from one of the axial wear members 230, 232 of each of the clamp assemblies 106, 108. The extension 1100, 1102 may be integrally formed as part of the axial wear members 230, 232 or may be a separate piece that is connected thereto. As shown, the extensions 1100, 1102 may be configured to fit radially between the outer sleeve 104 and the drill pipe 102. In particular, the extensions 1100, 1102 may be configured to fit between the end regions 107A, 107B, although, in other embodiments, at least one extension could be positioned between the shoulder 1000 (where provided) and the drill pipe 102. In embodiments including a single clamp assembly (i.e., spanning the entirety of the clamp-receiving portion 105 of the outer sleeve 104), the single clamp assembly may include two such extensions 1100, 1102, one extending axially from each of its axial wear members 230, 232.

The outer sleeve 104 may rotate relative to the drill pipe 102 and clamp assemblies 106, 108, while an inner surface of the end portions 107A, 107B thereof engages the extensions 1100, 1102. The extensions 1100, 1102 may thus be made of a low-friction, wear-resistant material, similar to or the same as, the axial wear members 230, 232. The extensions 1100, 1102 may be sized to extend all or a portion of the axial length of the end portions 107A, 107B, such that the axial ends of the extensions 1100, 1102 and the outer sleeve 104 are aligned. In other embodiments, the extensions 1100, 1102 may be shorter, and the ends thereof may be within the outer sleeve 104. In still other embodiments, such as, for example, the embodiment of FIG. 12, the extensions 1100, 1102 may extend axially past the ends of, and thus outwards of, the outer sleeve 104.

In the specific, illustrated embodiment, the extensions 1100, 1102 may each include an outboard shoulder 1104, 1106. The shoulders 1104, 1106 may be integral with the remainder of the extensions 1100, 1102, being formed by the extensions 1100, 1102 extending radially outward. The outboard shoulders 1104, 1106 may be formed so that the axial ends of the outer sleeve 104 may bear upon the outboard shoulders 1104, 1106 when an axial load is applied to the outer sleeve 104. Engagement of the outer sleeve 104 with the outboard shoulder(s) 1104, 1106 may be contemporaneous with rotation of the outer sleeve 104, and thus the outboard shoulders 1104, 1106 may provide for a relatively low-friction, wear-resistant interaction therebetween. An outer surface 1108, 1110 of the outboard shoulders 1104, 1106 may be tapered so as to provide a smooth transition from the drill pipe 102 outwards to the outer surface of the outer sleeve 104 as proceeding axially along the drill pipe 102.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. An apparatus for reducing torque in a drill string, comprising:

a first clamp assembly comprising a plurality of arcuate clamp segments that are pivotally connected together, the plurality of arcuate clamp segments being configured to be positioned around and secured to an oilfield tubular so as to be rotationally fixed to the oilfield tubular; and an outer sleeve positioned around the first clamp assembly, wherein the outer sleeve comprises at least two sleeve segments assembled together to form a generally cylindrical sleeve around the first clamp assembly, and wherein the first clamp assembly is configured to rotate with the oilfield tubular and with respect to the outer sleeve, wherein each of the plurality of arcuate clamp segments comprises:

a plurality of arcuate structural members; and a plurality of arcuate radial wear members, the plurality of arcuate radial wear members being interleaved between the plurality of arcuate structural members, and the plurality of arcuate radial wear members having a greater radial thickness than the plurality of arcuate structural members, wherein the plurality of arcuate radial wear members each comprise a wear material that has a lower coefficient of friction than a material of the plurality of arcuate structural members, wherein an outer diameter surface of the plurality of arcuate clamp segments is configured to slide against an inner diameter surface of the outer sleeve, and wherein the plurality of arcuate clamp segments are configured to prevent an outer surface of the plurality of arcuate structural members from sliding against the inner diameter surface of the outer sleeve.

2. The apparatus of claim 1, wherein at least a portion of at least one of the plurality of arcuate clamp segments is magnetic, such that the at least one of the plurality of arcuate clamp segments is attracted to the oilfield tubular.

3. The apparatus of claim 1, wherein each of the plurality of clamp segments comprises an axial wear member positioned on an axial end thereof and configured to engage and rotate relative to the outer sleeve.

4. The apparatus of claim 3, wherein the outer sleeve comprises an inner shoulder that is configured to engage the axial wear members of the plurality of arcuate clamp segments.

5. The apparatus of claim 1, wherein:

the first clamp assembly further comprises an axial wear member configured to engage a shoulder of the outer sleeve, and an extension extending axially from the axial wear member and positioned radially between the oilfield tubular and outer sleeve; and the outer sleeve comprises an end region having an inner diameter that is sized to engage the extension of the axial wear member.

6. The apparatus of claim 1, wherein the plurality of arcuate clamp segments comprises:

a first clamp segment comprising first and second circumferential ends; and a second clamp segment comprising first and second circumferential ends.

7. The apparatus of claim 6, wherein the second circumferential end of the first clamp segment is releasably coupled to the first circumferential end of the second clamp segment and the first circumferential end of the first clamp segment is releasably coupled to the second circumferential end of the second clamp segment.

8. The apparatus of claim 7, wherein a connection between the first clamp segment and the second clamp segment is adjustable so as to adjust a circumference of the first clamp assembly, to secure the first clamp assembly to the oilfield tubular.

9. The apparatus of claim 6, wherein the plurality of arcuate clamp segments further comprises:

an intermediate clamp segment comprising first and second circumferential ends, wherein the first circumferential end of the first clamp segment is releasably coupled to the first circumferential end of the second clamp segment, the first circumferential end of the intermediate clamp segment is releasably coupled to the second circumferential end of the first clamp segment, and the second circumferential end of the intermediate clamp segment is releasably coupled to the second circumferential end of the second clamp segment.

10. The apparatus of claim 1, further comprising a second clamp assembly that is substantially identical to the first clamp assembly.

11. The apparatus of claim 10, wherein the second clamp assembly is positioned axially adjacent to the first clamp assembly and secured to the oilfield tubular so as to be rotationally fixed to the oilfield tubular, and wherein the outer sleeve is positioned around the first and second clamp assemblies.

12. The apparatus of claim 10, wherein the second clamp assembly is configured to be spaced axially apart from the first clamp assembly, wherein the outer sleeve comprises a medial shoulder that is positioned axially between the first and second clamp assemblies, and wherein the medial shoulder is configured to slide against at least one of the first clamp assembly or the second clamp assembly when the outer sleeve rotates with respect to the first and second clamp assemblies.

13. A method for installing an apparatus for reducing torque in a drill string, comprising:

positioning at least one clamp assembly around a tubular, wherein the clamp assembly comprises a plurality of arcuate structural members and a plurality of arcuate radial wear members each disposed between two of the plurality of arcuate structural members and having a greater radial thickness than the plurality of arcuate structural members, and wherein the plurality of arcuate radial wear members each comprises a wear material that has a lower coefficient of friction that a material of the plurality of arcuate structural members;

connecting together two circumferential ends of the clamp assembly, wherein connecting comprises tightening a connection between the two circumferential ends of the clamp assembly, to cause the clamp assembly to apply a gripping force to the tubular; and assembling an outer sleeve around the clamp assembly, such that the clamp assembly is received within the outer sleeve, wherein an inner diameter surface of the outer sleeve is configured to engage an outer diameter surface of the plurality of arcuate radial wear members, wherein the plurality of arcuate radial wear members are configured to prevent an outer surface of the plurality of arcuate structural members from sliding against the inner diameter surface of the outer sleeve, and wherein the outer sleeve is rotatable relative to the clamp assembly.

14. The method of claim 13, wherein connecting the two circumferential ends of the clamp assembly comprises:

pivoting a first clamp segment of the clamp assembly with respect to a second clamp segment of the clamp assembly while the first and second clamp segments are coupled together; and tightening a fastener to draw the two ends together so as to circumferentially shorten the clamp assembly thereby tightening the clamp assembly onto the tubular.

15. An apparatus for reducing torque in a drill string, comprising:

a first clamp assembly comprising a plurality of arcuate clamp segments that are pivotally connected together, the plurality of arcuate clamp segments being configured to be positioned around and secured to an oilfield tubular so as to be rotationally fixed to the oilfield tubular;

an outer sleeve positioned around the first clamp assembly, wherein the outer sleeve comprises at least two sleeve segments assembled together to form a generally cylindrical sleeve around the first clamp assembly, wherein the first clamp assembly is configured to rotate with the oilfield tubular and with respect to the outer sleeve, wherein each of the plurality of arcuate clamp segments comprises:

a plurality of arcuate structural members; and a plurality of arcuate radial wear members, the plurality of arcuate radial wear members being interleaved between the plurality of arcuate structural members, and the plurality of arcuate radial wear members having a greater radial thickness than the plurality of arcuate structural members, wherein the plurality of arcuate radial wear members each comprise a wear material that has a lower coefficient of friction than a material of the plurality of arcuate structural members, wherein an outer diameter surface of the plurality of arcuate clamp segments is configured to slide against an inner diameter surface of the outer sleeve, and wherein the plurality of arcuate clamp segments are configured to prevent an outer surface of the plurality of arcuate structural members from sliding against the inner diameter surface of the outer sleeve.

16. The apparatus of claim 15, further comprising a plurality of adjustable fasteners connecting the plurality of arcuate segments together.

17. The apparatus of claim 15, further comprising a second clamp assembly that is positioned around the oilfield tubular axially adjacent to the first clamp assembly, wherein the outer sleeve is positioned around the second clamp assembly.

18. The apparatus of claim 17, wherein the first clamp assembly is substantially identical to the second clamp assembly.

19. The apparatus of claim 15, wherein the plurality of arcuate structural members are coated with a friction-reducing coating.

* * * * *